United States Patent [19]

Nowacki

[11] Patent Number: 4,463,541

[45] Date of Patent: Aug. 7, 1984

[54] APPARATUS AND METHOD FOR AUTOMATICALLY PACKING ARTICLES IN CATONS

[75] Inventor: Ulrich G. Nowacki, Leisure City, Fla.

[73] Assignee: International Paper Company, New York, N.Y.

[21] Appl. No.: 282,593

[22] Filed: Jul. 13, 1981

[51] Int. Cl.[3] ..... B65B 11/20

[52] U.S. Cl. ..... 53/447; 53/207; 53/462; 53/540

[58] Field of Search ..... 53/447, 448, 207, 209, 53/228, 230, 220, 537, 540, 543, 462, 466, 461

[56] References Cited

U.S. PATENT DOCUMENTS

| | | | |
|---|---|---|---|
| 3,482,372 | 12/1969 | Hottendorf | 53/207 X |
| 3,771,282 | 11/1973 | Flanagan | 53/207 X |
| 3,872,650 | 3/1975 | Vickers | 53/207 |
| 3,882,655 | 5/1975 | Monaghan | 53/209 X |
| 3,964,239 | 6/1976 | Elford | 53/207 X |
| 4,149,452 | 4/1979 | Talarico | 53/207 X |

*Primary Examiner*—James F. Coan

*Attorney, Agent, or Firm*—Thomas L. Giannetti

[57] ABSTRACT

Automatic wraparound packaging machinery comprising a carton blank feeding station, can accumulator, lowerator platform and gluing and sealing station is provided with a loading head adapted for receiving the supply of articles (e.g., cans) to be packed and for forming the articles into discrete groups. The apparatus further comprises a retractable loading curtain associated with the loading head and means associated with the loading head for retracting the loading curtain to release the group of articles formed in the loading head and for returning the loading curtain to its normal position for supporting the next group of articles formed in the loading head. In one embodiment, the articles are packed in the carton in one tier. In another embodiment, releasable lifting means are provided for lifting every other group or articles to form an upper and a lower tier of articles, thus producing a two-tiered arrangement of articles to be packed.

13 Claims, 15 Drawing Figures

APPARATUS AND METHOD FOR AUTOMATICALLY PACKING ARTICLES IN CATONS

BACKGROUND OF THE INVENTION

This invention relates to the automatic packing of articles (e.g., cans or bottles) in paperboard cartons. The invention is particularly suited for use with certain automatic packaging apparatus called "wraparound" packaging machines. Such wraparound machines package articles by folding, or "wrapping", a flat corrugated paperboard carton blank having various panels and flaps defined by score lines around a group of such articles (usually arranged in a rectangular or square pattern, e.g., 4 by 3) to be packaged. This is in contrast with automatic packing apparatus wherein the articles to be packed are automatically placed, individually or in groups, in partially or fully erected paperboard cartons, which cartons are then sealed.

The advantages of making automatic wraparound packing machinery fast and reliable, and at the same time relatively inexpensive, are apparent. However, prior to the present invention, high speed wraparound packing machinery was typically relatively more expensive and complicated.

Typical automatic wraparound packing machinery employs a conveyor belt to feed the cans or other articles from the filling and capping station toward that part of the apparatus adapted for wrapping the carton blank around the groups of articles to be packed. This conveyor belt typically is disposed at a 90° angle to the direction of feed through the machine, in order to to provide an area, sometimes referred to as a "holding station", between the aforementioned feed conveyor belt and the rest of the machine in which the cans or other articles to be packed are assembled into groups for packing. A second conveyor belt for transporting the packed cartons away from the packing machinery is typically positioned below the level of the feed conveyor belt. Such packing machinery also typically feeds the flat, unfolded carton blanks horizontally onto a vertically movable platform, or "lowerator", which is automatically raised to the level of the aforementioned feed conveyor belt for receiving the articles to be packed, and lowered to the level of the aforementioned second conveyor belt for discharging the packed cartons and for transporting the packed cartons away from the packing machinery.

With the movable platform in its upper position at the level of the first conveyor, and with the carton blank in place on the platform, a group of cans or other articles is typically moved into place from the holding station onto the blank by a reciprocating mechanism, or "pusher".

With the articles in place on the blank, the platform is lowered to the level of the discharge conveyor belt, the carton blank being automatically partially "wrapped" or folded along its score lines around its contents as the platform is being lowered from the level of the feed conveyor belt to the level of the discharge conveyor belt. Thereafter the carton is moved automatically, typically by a piston-actuated ram, onto the discharge conveyor belt. The automatic folding operation is completed and the carton flaps are glued in place as the carton moves from the lowerator to the second conveyor belt. The platform is then raised to receive the next carton blank and group of articles to be packed.

Disadvantages of the aforementioned typical apparatus and method of wraparound packing should be apparent. For example, delay is incurred in the packing process while the moving platform is being raised and the carton blank moved into position on the platform. Further delay is incurred while the reciprocating pusher moves a group of articles onto the carton blank and withdraws. And because the feed conveyor belt is disposed horizontally at a 90° angle to the direction of flow through the packing machine, the operation is less efficient and there is a greater danger that articles will be damaged than if the articles were permitted to flow in the same horizontal direction throughout the packing process.

My invention overcomes these and other disadvantages of prior automatic wraparound packing machines, and permits packing speeds of up to 22 cartons per minute, whereas the machinery described above typically operates at a maximum packing speed of around 15 cartons per minute.

Accordingly, an object of this invention is to provide a relatively fast, efficient, simple and economical method of packing articles, for example, cans, in paperboard cartons.

Another object of this invention is to provide means for avoiding packing delays found in certain automatic wraparound packing machinery, thereby improving packing speed.

Another object of this invention is to provide means for simplifying automatic wraparound packing machinery, making such machinery less expensive and easier to maintain, while at the same time permitting high speed operation of at least 22 cartons per minute.

Another object of my invention is to provide means for reducing the risk of damage to the articles to be packed by avoiding feeding the articles to the packing apparatus at a horizontal angle of 90° to the direction of feed through the machine.

SUMMARY OF THE INVENTION

In accordance with the present invention, there is provided an apparatus and method for packing a plurality of articles in a paperboard carton, the carton being initially in the form of a carton blank having a plurality of score lines defining the panels and flaps of the paperboard carton to be formed therefrom.

In one embodiment, the invention comprises a means for feeding a plurality of articles to be packed, means for forming discrete groups of those articles, and a first means for supporting each of said groups of articles. This first supporting means is releasable to cause each discrete group of articles to drop vertically when released. The invention further comprises means for positioning a carton blank beneath the first supporting means, for receiving the articles released by the first supporting means.

The invention further comprises a second supporting means for supporting both the carton blank and the group of articles released by the first supporting means, and timing means cooperating with the group forming, first supporting, carton blank positioning and second supporting means for causing the first supporting means to release a group of articles and for causing the positioning and supporting of the carton blank beneath the group of articles to receive those articles when released, and means cooperating with the second supporting means for folding the carton blank substantially to wrap the carton blank around the group of articles positioned and supported thereon to form the carton. The timing means further cooperates with the folding, feeding, first and second supporting and group forming means to permit the forming of a subsequent group of articles to be packed supported by the first supporting means while the folding means is simultaneously wrapping the carton blank around the first group of articles.

In accordance with an embodiment of invention described herein, automatic wraparound packaging machinery comprising a carton blank feeding station, can accumulator, lowerator platform and gluing and sealing station is further provided with a loading head adapted for receiving the supply of articles to be packed (e.g., cans) provided by the can accumulator and for grouping the cans into discrete groups whose dimensions correspond generally to the dimensions of the articles to be packed. The apparatus further comprises a retractable loading curtain associated with the loading head, comprising a plurality of parallel, horizontally spaced rotatable members disposed beneath the groups of articles formed by the loading head and adapted and arranged for supporting those articles in the loading head. The packing apparatus further comprises means associated with the loading head for retracting the loading curtain to release the group of articles formed in the loading head and for returning the loading curtain to its normal position for supporting the next group of articles formed in the loading head, and gate means associated with loading head and can accumulator for preventing the flow of articles from entering the loading head when the loading curtain is retracted, and for resuming the flow when the loading curtain is restored to its normal position. Timing means associated with the loading head and gate means return the loading curtain to its normal position and operate the gate means so as to permit the flow of articles into the loading head to be resumed simultaneous with the forming of the carton by a folding means associated with the lowerator platform.

In accordance with a further embodiment of the present invention decribed herein, automatic wraparound packaging machinery is further provided with apparatus for packing a plurality of articles in two tiers in paperboard cartons. Means are provided for feeding the articles, for forming discrete groups of articles to be packed, and for lifting the first of those groups to create an upper tier. The lifting means (e.g., suction heads) are releasable to permit the upper tier of articles to drop vertically when released. A first supporting means for supporting the next discrete group of articles also is provided, which supporting means also is releasable to permit the lower tier of articles to drop vertically when released. The apparatus further comprises means for positioning a carton blank beneath the lifting and first supporting means to receive the upper and lower tiers of articles, when released, and a second supporting means for supporting the carton blank and first and second tiers of articles received by the carton blank. Timing means cooperating with the group forming, lifting and first and second supporting means causes the lifting means to lift the upper tier of articles while the lower tier is being formed, causes the lifting and the first supporting means to simultaneously release the upper and lower tiers of articles to be packed, and causes the positioning of each carton blank and the second supporting means beneath the group of articles to receive both tiers when released. Folding means cooperating with the second supporting means fold the carton blank around the tiers of articles to form a carton. The timing means further cooperates with the feeding, group forming, first and second supporting and folding means to cause the forming of subsequent upper and lower tiers of articles supported by the lifting and first supporting means while the folding means is wrapping the carton blank around the upper and lower tiers of articles.

DESCRIPTION OF THE PREFERRED EMBODIMENTS

Figure 1:
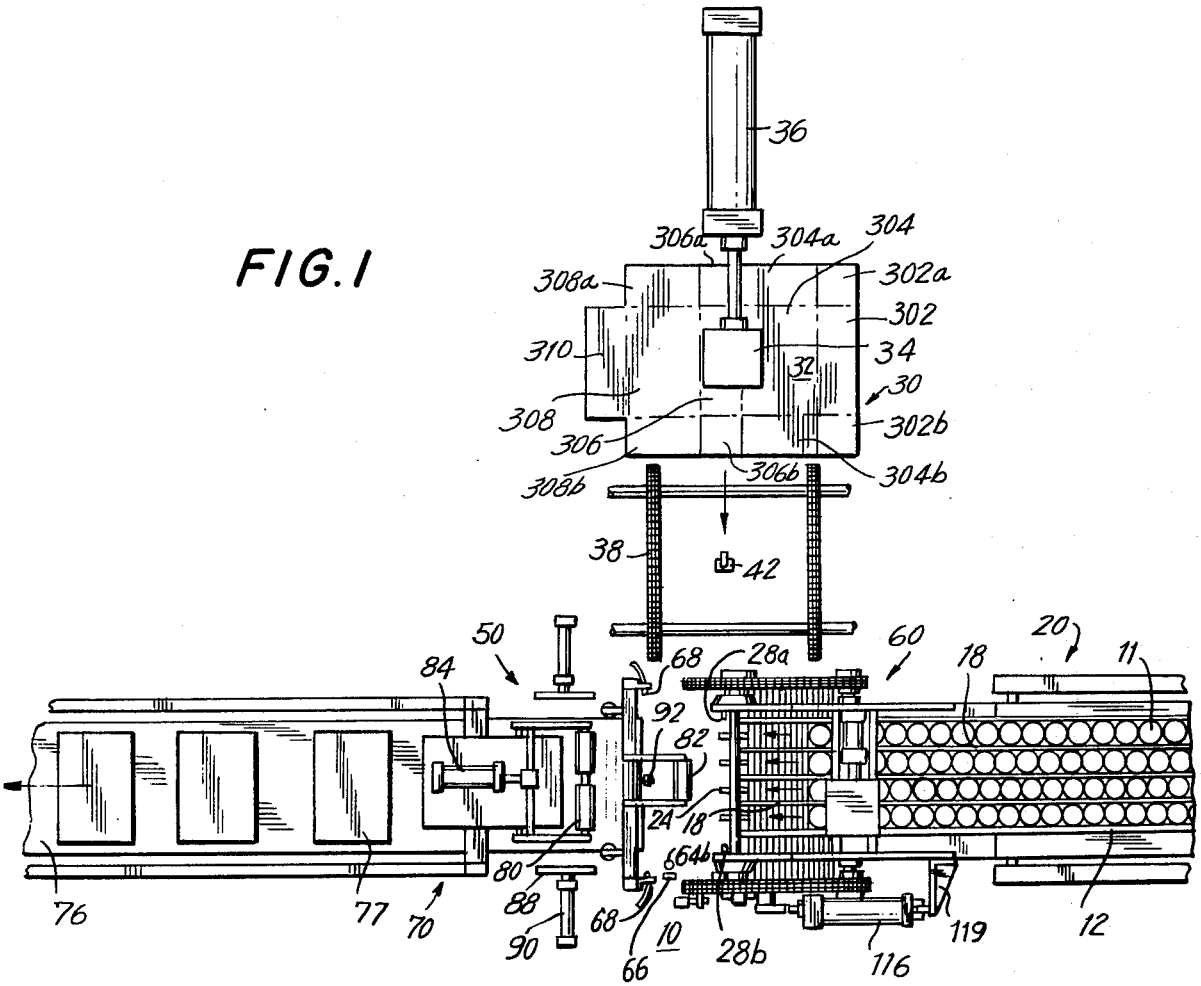
FIG. 1 is a top plan view of automatic wraparound packing apparatus embodying the present invention, showing the articles (cans) partially filling the loading head.
Figure 2:
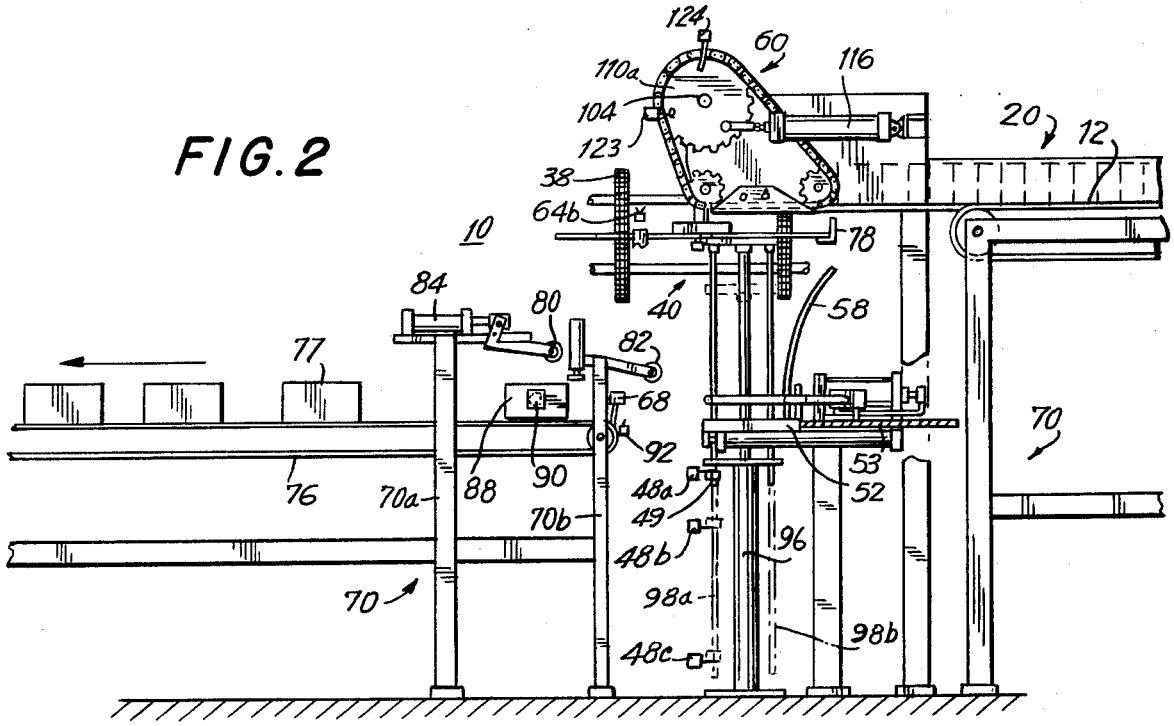
FIG. 2 is a side elevational view of the apparatus of FIG. 1.
Figure 3:
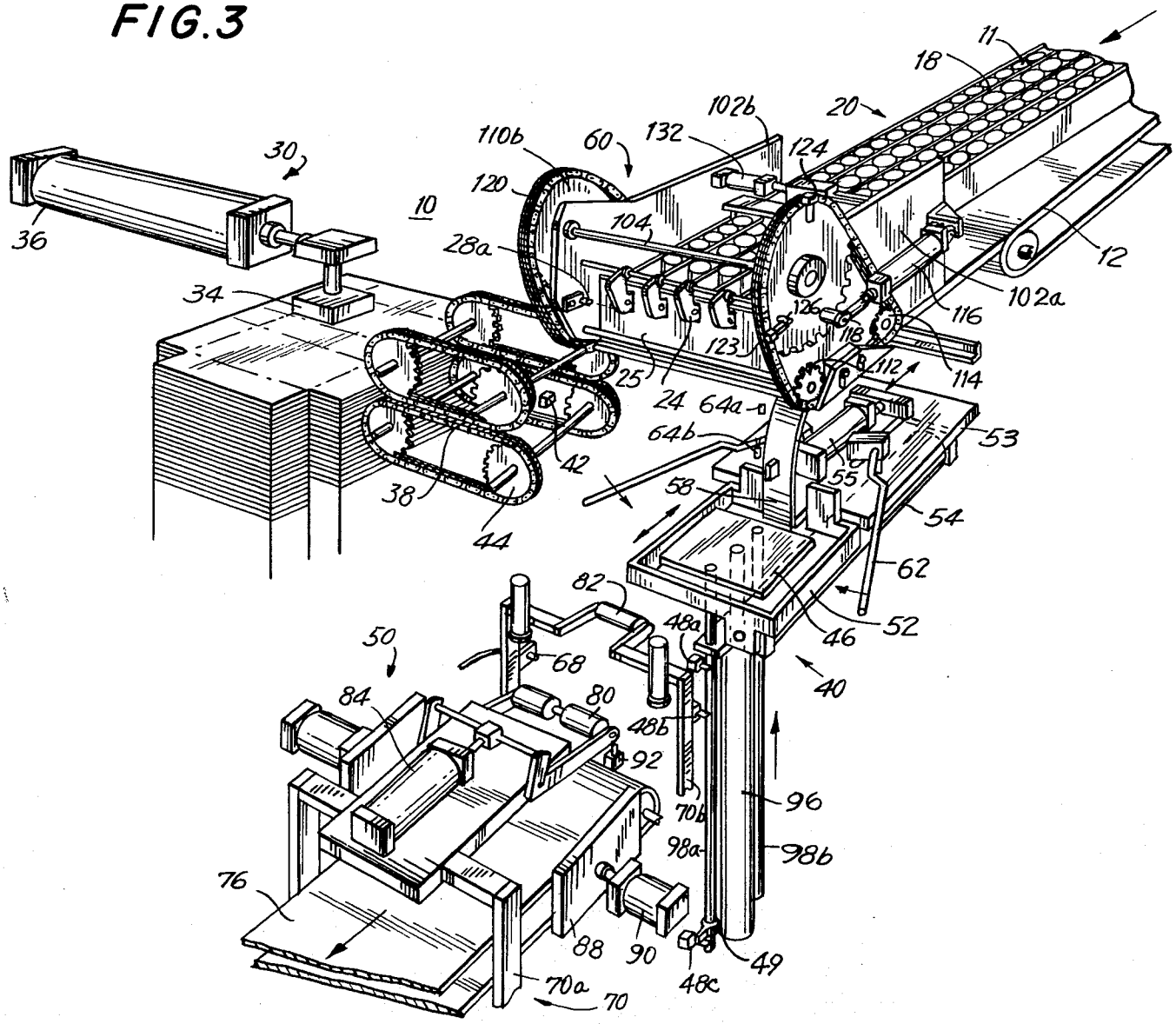
FIG. 3 is a front perspective view of the apparatus of FIG. 1.

Referring initially to FIGS. 1–3, there is shown illustrative automatic wraparound packaging machinery 10 for packing cans, embodying the present invention. Broadly speaking, the apparatus is comprised of can accumulator 20, blank feeding station 30, lowerator apparatus 40, gluing and sealing station 50 and loading head 60. The parts of the machine are supported on a frame, shown generally as members 70 (FIG. 2).

The blank feeding station, lowerator apparatus and gluing and sealing station described herein are intended to be exemplary only, and it should be clear that other appropriate apparatus known to those familiar with the art could be used in place of that described herein.

Cans 11 emerge in single file at high speed from the filling and capping machinery (not shown) and proceed into a can flooding area (not shown) where they are picked up and moved transversely by travelling conveyor belt 12, entering the can accumulator 20 travelling toward loading head 60 in the direction shown by the arrow at the top right in FIG. 3. The can accumulator is provided with one or more baffle plates or lane dividers 18, which divide the cans entering the can accumulator into lanes and keep the lanes separate as the cans move through the accumulator into the loading head. Lane dividers 18 extend into the loading head (see FIG. 1).

Figure 4:
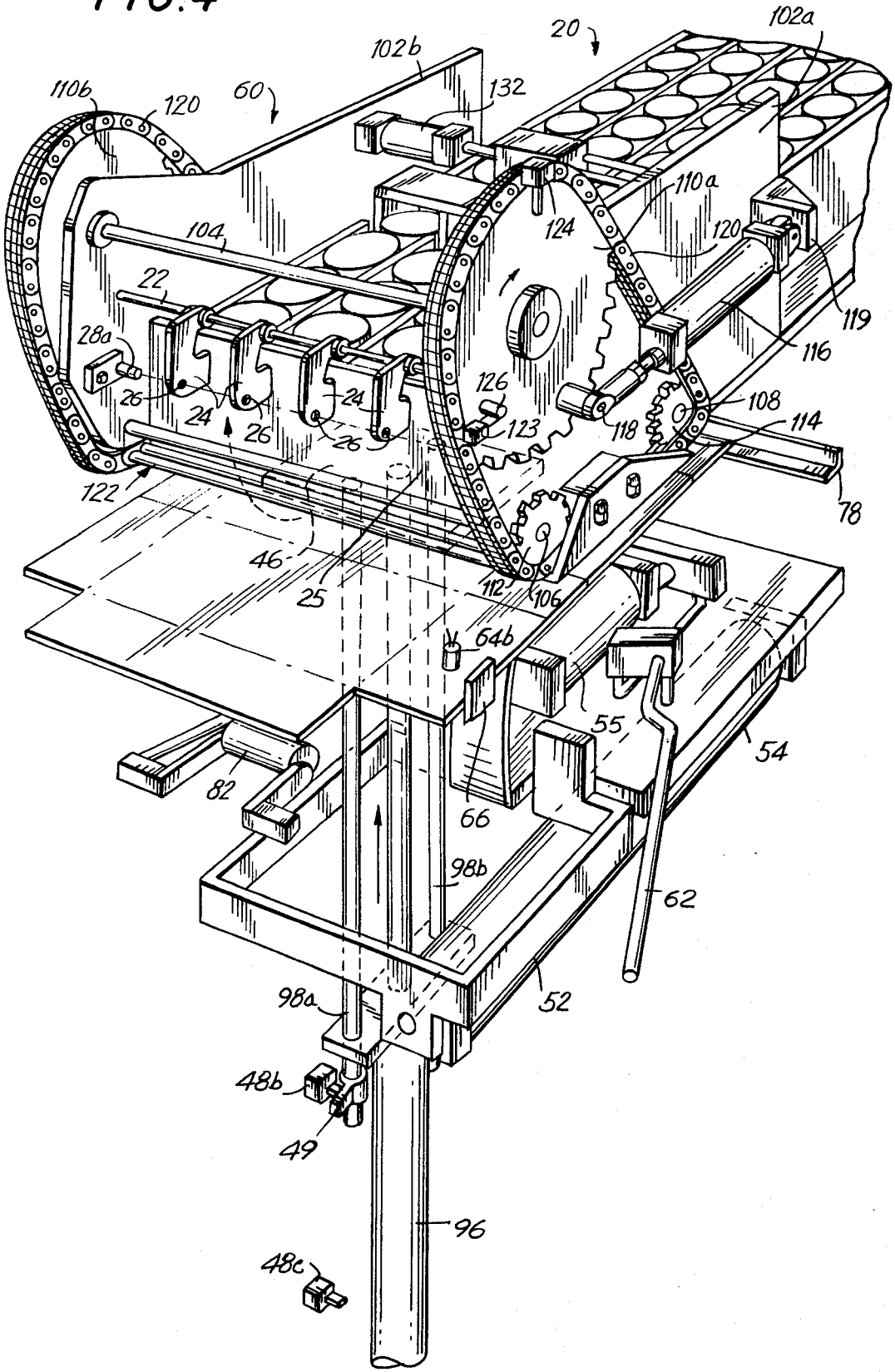
FIG. 4 is a fragmentary front perspective view of the loading head and lowerator of the apparatus of FIG. 1, shown with the loading head filled and the loading curtain in place, just prior to the release by the loading head of the cans to be packed.
Figure 7:
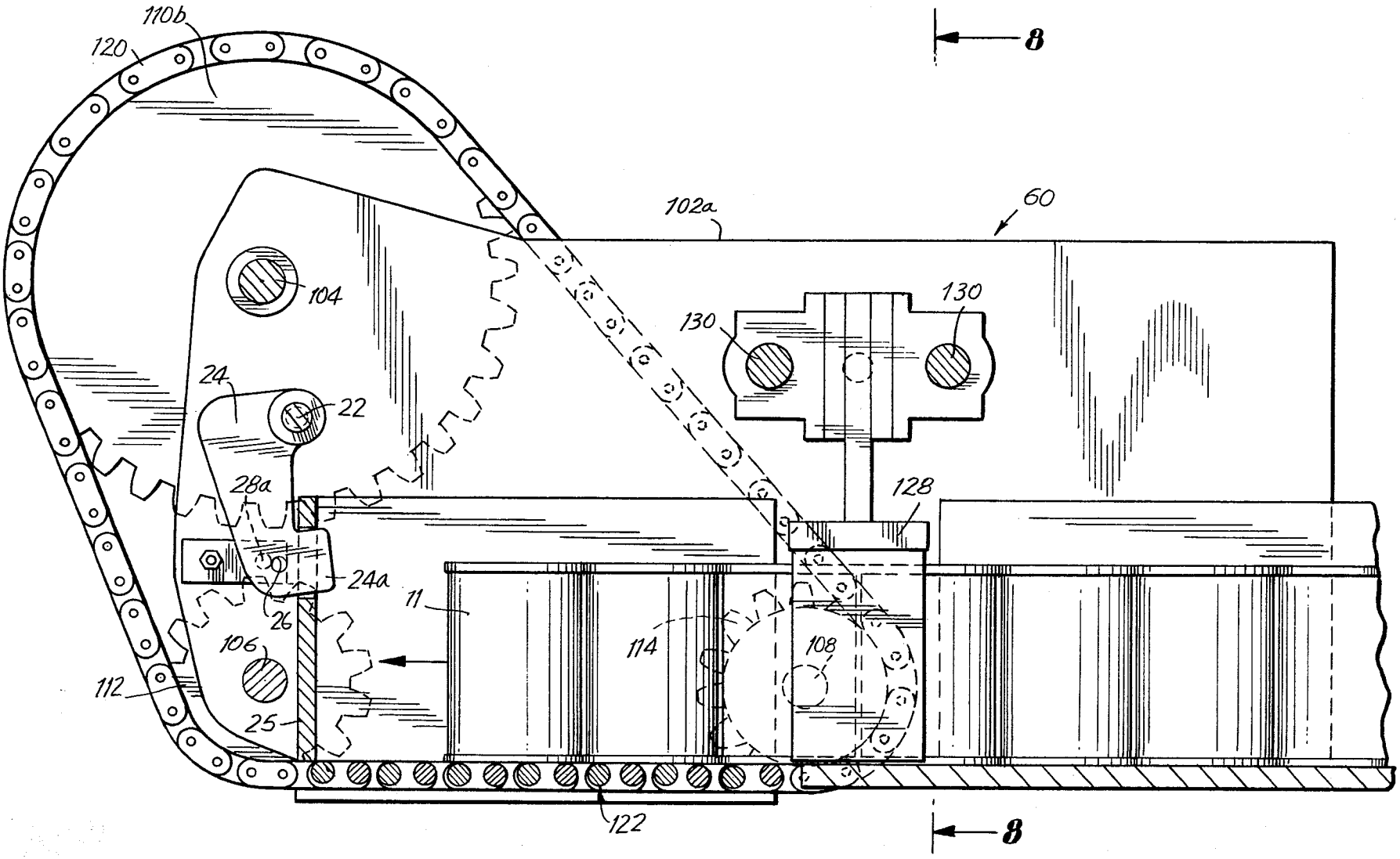
FIG. 7 is a cross-sectional view taken along line 7—7 in FIG. 6.

As shown in FIGS. 3 and 4, located in the loading head at the head of each lane is a swinging member 24 journaled to shaft 22 mounted transversely on the loading head, each swinging member having a finger 24*a* protruding through an aperture in loading head end plate 25. (See FIG. 7). As shown in FIG. 7, each member 24 is tensioned so that its finger normally extends through the aperture in end plate 25 into the lane, such that when the frontmost can in the lane reaches the end plate (when the respective lane is filled with cans), the frontmost can impinges upon the finger 24*a* protruding into the lane and causes the associated member 24 to rotate on shaft 22, to the position shown in FIG. 10. Swinging members 24 are each further provided with an identically positioned aperture 26 (see FIG. 4). When all members 24 are rotated into the position shown in FIG. 10, i.e., when the frontmost can in each lane has reached end plate 25, apertures 26 are aligned.

Figure 10:
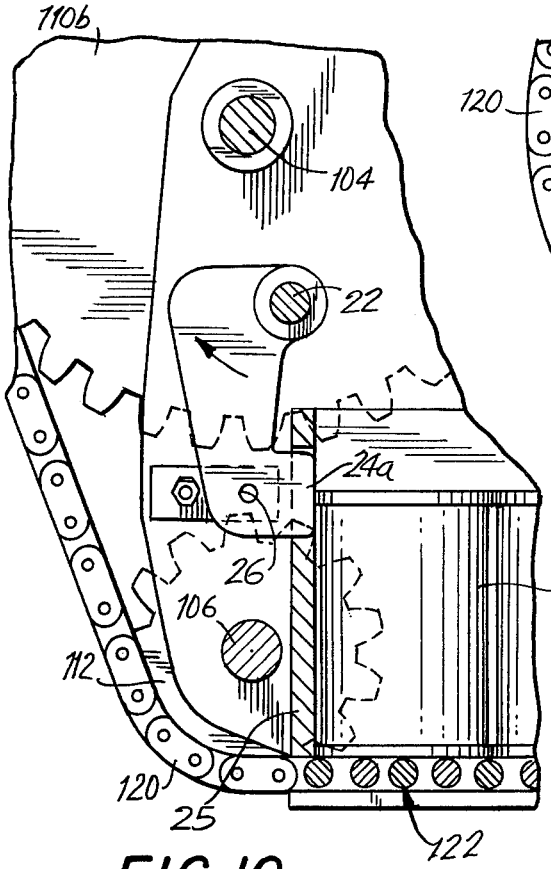
FIG. 10 is a fragmentary sectional view of the loading head taken along line 10—10 in FIG. 9.

Photoelectric detector 28*a*–28*b* (FIG. 6) mounted on the loading head is positioned such that when one or more of members 24 are in the position shown in FIG. 7, the beam of the photoelectric detector is broken, whereas when all of members 24 are in the position shown in FIG. 10, the beam passes through aligned apertures 26 in members 24 and is detected. In this manner, the condition wherein the lanes of the loading head are full can be detected, and an electrical signal produced.

The packing machine is further provided with blank feeding mechanism 30 for feeding flat paperboard carton blanks 32 from the top of a vertical stack of such blanks. The feed mechanism includes reciprocating feed arm 34 and pneumatic piston-cylinder 36, which in cooperation feed the topmost carton blank in the stack between moving platens 38 driven through gear wheels 44 (FIG. 3) by a power source (not shown) in such a way as to feed the blank into the packing machinery.

Feeding mechanism 30 is further provided with limit switch 42, situated so as to be actuated by a carton blank passing through the feeding mechanism and thereby providing an electrical signal when such a blank is fed.

The automatic packaging machine is further provided with lowerator 40, comprising a vertically movable platform 46, guide rods 98*a* and 98*b*, supported by the frame, and associated pneumatic piston-cylinder 96 for moving the platform from its upper stationary position directly beneath loading head 60, as shown in FIGS. 2 and 4, to its lower stationary position (FIG. 3). When in its upper position, lowerator platform 46 is positioned to receive the carton blank fed by blank feeder 30, and to support the blank directly beneath the loading head 60, as shown in FIGS. 2 and 4. In that position, the blank is also supported on its edge by ledge 78 (FIGS. 2 and 4), mounted on the frame. As described in detail below, it is in the lowerator platform's upper position that the carton blank, supported by the lowerator platform, receives the articles to be packaged from the loading head directly above, and it is during the descent of the lowerator platform from its upper to its lower position that the carton blank is folded, or wrapped, around the articles on the platform, the completion of the wrapping and sealing operation taking place as the carton moves through sealing station 50 from the lowerator.

As shown in FIGS. 2 and 3, the lowerator apparatus is further provided with three frame-mounted limit switches 48*a*, 48*b* and 48*c*, actuated by member 49 affixed to guide rod 98*a* of the lowerator. The topmost switch, 48*a*, is actuated when lowerator platform 46 reaches its upper position. Likewise, as is apparent from FIGS. 2 and 3, limit switches 48*b* and 48*c* are actuated when the lowerator platform moves through an intermediate position and reaches its lower stationary position, respectively.

Slidably mounted ram 52, which is normally in the position shown in FIGS. 2 and 3, is mounted on base 53 supported by the frame, as shown in FIG. 3. Affixed to the undersurface of the base is pneumatic piston-cylinder 54, for driving ram 52 horizontally forward from and backward to its normal position, as shown by the arrow in FIG. 3.

Mounted on the base below the loading head is arcuate member 58 (FIG. 3), which participates in the folding of the carton flaps, as described below. Members 62 pivotally mounted on the base (see FIG. 4) are operated by pneumatic piston-cylinder 55 to pivot horizontally inward and outward when the piston-cylinder is actuated to fold certain flaps of the carton blank along their score lines, as described more fully below.

Also mounted on the frame (see FIG. 3) are elements 64*a*–64*b* of a photoelectric detector. The elements are positioned such that the beam is broken by the leading edge of the carton blank when the carton blank is moved into its proper place on lowerator platform, as shown in FIG. 4. Thus, the condition wherein a carton blank is present on the lowerator platform is detected, and an electrical signal produced. To aid in positioning the blank on the lowerator platform, stop 66 is affixed to the frame near elements 64*a*–64*b* (see FIG. 1). The leading edge of carton blank 32 comes to rest against stop 66 shortly after breaking the beam of photoelectric detector 64*a*–64*b*.

The automatic packing machine is further provided with gluing and sealing station 50, supported on the frame at the lower stationary level of the lowerator platform, which also corresponds to the level of base 53 and the ram and other apparatus supported by the base. A travelling conveyor 76 for moving the packed cartons 77 horizontally through the gluing and sealing station and away from the packing machine in the direction shown by the arrows in FIG. 2 also is supported by the frame, as shown. Glue guns 68 for applying adhesive to the carton flaps also are mounted on the frame, as shown in FIGS. 1 and 2, above conveyor 76 and to either side. Located directly above conveyor 76 and mounted on frame members 70*a* and 70*b*, respectively, are flap sealers 80 and 82. Pneumatic piston-cylinder 84 is linked to flap sealer 80 (which in turn is hingedly mounted to member 70*a*, as shown in FIGS. 2 and 3) to rotate the sealer about its hinges in the vertical plane and thereby to raise and lower the sealer.

As best shown in FIGS. 1 and 2, side flap sealers 88 also are mounted on the gluing and sealing station to either side of the conveyor belt, and can be horizontally driven inwardly toward the conveyor belt by pneumatic piston-cylinders 90 to provide opposing compressive forces for sealing the side flaps of the carton, as described in more detail below. Limit switch 92 positioned at the edge of conveyor belt 76 is actuated when a packed carton is pushed from the lowerator platform by ram 52 onto conveyor 76 associated with gluing and sealing station 50. Thus, the condition wherein a packed carton leaves the lowerator platform and enters the gluing and sealing station can be detected, and an electrical signal produced.

Turning now to a description of loading head 60, with particular reference to FIGS. 4–9, vertical sidewalls 102*a* and 102*b* of the loading head support each end of horizontal shafts 104, 106 and 108, which are journaled for rotation with respect to the loading head end walls. At opposite ends of shafts 104, 106 and 108 are rigidly mounted large sprocket wheels 110*a* and 110*b*, and small sprocket wheel pairs 112 and 114, respectively.

Sidewalls 102*a* and 102*b*, and endwall 25 of the loading head define a rectangular horizontal opening in the floor of the loading head through which, as will be described in more detail below, the articles to be packed are dropped onto the carton blank positioned beneath the loading head on the lowerator platform. The opening is sized and shaped to correspond to the size and shape of the group of articles to be packed. This, in turn, corresponds to the size and shape of the bottom panel of the carton to be packed. For example, in the apparatus illustrated in FIGS. 1–11, a 4 by 3 arrangement of cans is shown (see FIG. 5). Of course, other arrangements could be achieved by varying the dimensions of the loading head and of the carton, and the number of lanes in the can accumulator. The loading head is opened on the end opposite endwall 25 to receive the flow of cans from the can accumulator. (See FIG. 8).

Pneumatic piston-cylinder 116 is attached between horizontal member 118 affixed to large sprocket wheel 110*a*, and support member 119 rigidly mounted on sidewall 102*a*. The connection between piston-cylinder 116 and member 118 is rotatable, member 118 being eccentrically positioned on sprocket wheel 110*a* such that when piston-cylinder 116 is pneumatically operated to extend the piston from the cylinder, that action causes a clockwise rotation of sprocket wheels 110*a* and 110*b* (see arrow in FIG. 4), and when the piston-cylinder is operated to retract the piston into the cylinder, that action causes a counterclockwise rotation of sprocket wheels 110*a* and 110*b* (see arrow in FIG. 5).

Endless chains 120 engage large sprocket wheels 110*a* and 110*b*, and small sprocket wheels 112 and 114 on either side of the loading head. Affixed to and supported by endless chain 120 is a loading curtain 122 formed from a pluarlity of parallel, closely spaced horizontally disposed rod members rotatably connected on each end to the endless chain. (See FIG. 5.) As can be seen in FIG. 6, the length and width of curtain 122 are determined by the dimensions of the horizontal opening in the loading head, which is in turn determined by the size and shape of the articles to be packed and of the bottom panel of the carton to be filled, as described above. As explained in more detail below, the loading curtain is adapted to support the group of cans or other articles to be packed, and to be withdrawn by actuating piston-cylinder 116, to remove support from the group of articles to permit them to drop as a group onto the carton blank positioned on and supported beneath the loading head by lowerator platform 46.

Loading head 60 is also provided with limit switches 123 and 124, actuated by horizontally protruding member 126 affixed to large sprocket wheel 110*a*. The limit switches and member 126 are positioned such that switch 124 is actuated when sprocket wheels 110*a* and 110*b* have achieved their maximum clockwise rotation of approximately 120° and loading curtain 122 is fully retracted by piston-cylinder 116 (see FIG. 5) and such that switch 123 is actuated when the sprocket wheels have reached their maximum counterclockwise rotation and the loading curtain has returned to its normal position for receiving and supporting the next group of articles to be loaded (FIG. 4). Thus, through limit switches 123 and 124, in cooperation with sprocket wheel 110*a* and member 126, the condition wherein the loading curtain is fully withdrawn can be detected, as can the condition wherein the curtain is in its normal position for loading, and electrical signals corresponding to those conditions can be produced.

Figure 8:
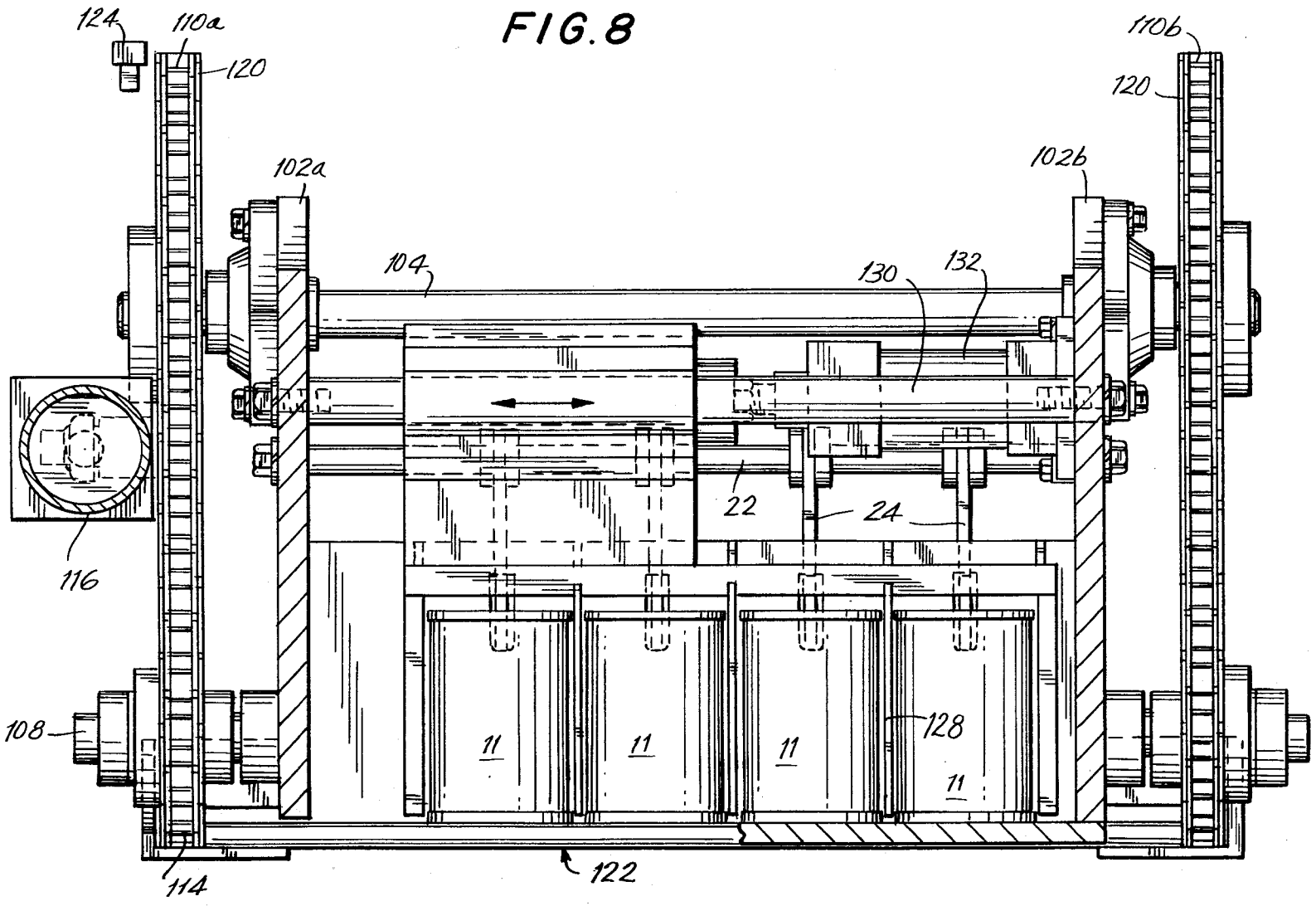
FIG. 8 is a cross-sectional view taken along line 8—8 in FIG. 7.
Figure 9:
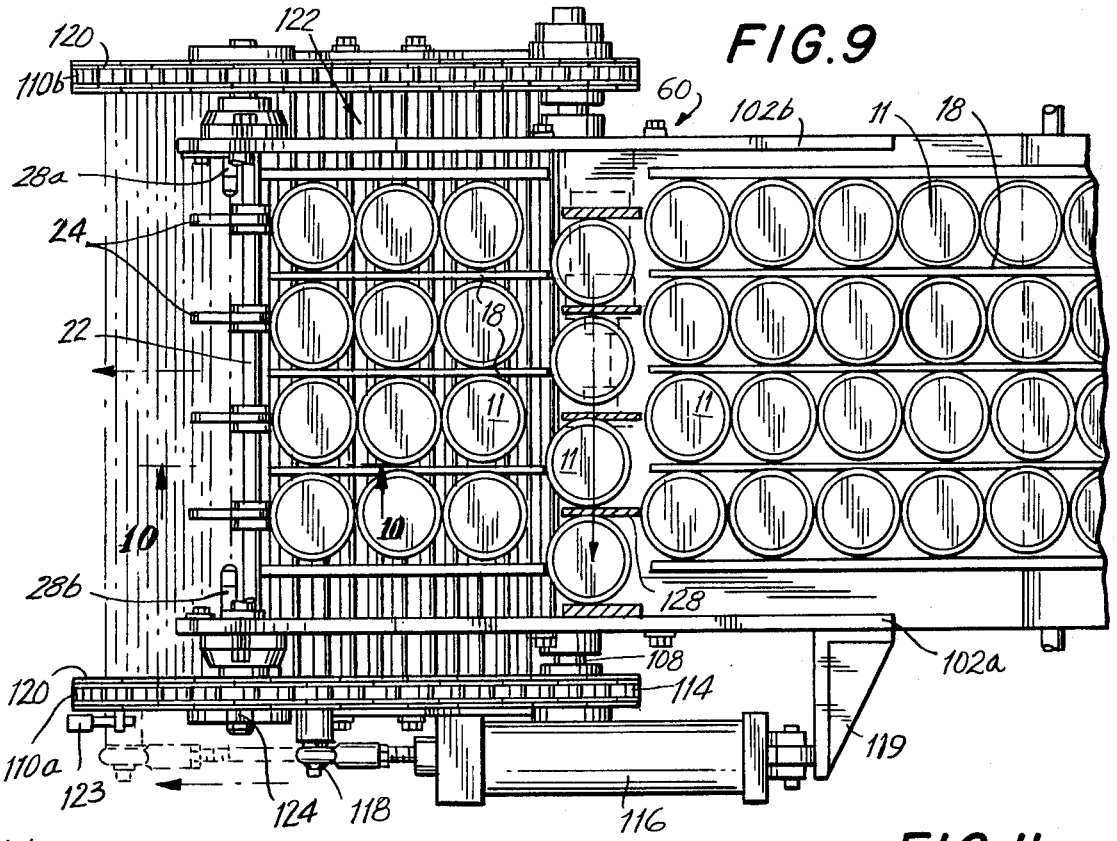
FIG. 9 is a fragmentary partial top plan view of the loading head and can accumulator of the apparatus of FIG. 1, shown with the product gate transversely shifted to block the further movement of cans into the loading head.

The packing apparatus also is provided with a gate mechanism for stopping the flow of articles from can accumulator 20 into the loading head while the loading curtain is retracted. As best shown in FIGS. 6, 7 and 8, a transverse section 128 of can accumulator 20 adjacent the loading head (including the baffles or lane dividers) is slidably supported by horizontal members 130 affixed on either end to end walls 102*a* and 102*b* of the loading head, to form a product gate.

Pneumatic piston-cylinder 132, rigidly connected between sidewall 102*b* and movable product gate 128, is actuated to move the product gate transversely in the directions shown by the arrow in FIG. 8. With product gate 128 in the position shown in FIG. 8, the baffles or lane dividers 18 in the product gate are aligned with the lane dividers in the can accumulator, thereby permitting cans to proceed unimpeded through the can accumulator into the loading head to be supported by the loading curtain. (See also FIG. 6.) When the product gate is moved into the position shown in FIG. 9, this causes a misalignment between the land dividers in the product gate and those in the can accumulator, preventing cans from flowing into the loading head. Thus, by slidably moving product gate from the position shown in FIGS. 6 and 8 to the position shown in FIG. 9, piston-cylinder 132 controls the flow of cans from the can accumulator 20 into the loading head.

Although not shown in the drawings, the packing machinery also includes conventional pneumatic and electrical supply lines, actuators and related apparatus associated with the various piston-cylinders, limit switches and other such equipment described above.

Having now described the major components of the packing apparatus and their interconnection, the step-by-step operating sequence followed by the apparatus in packing articles into a carton will be followed through one cycle.

As heretofore mentioned, the cycle operation begins as cans 11 emerge from the filling and capping machinery (not shown) into the flooding area (not shown) and onto conveyor belt 12, which transports them through can accumulator 20 into loading head 60 in lanes formed by lane dividers 18. As the lead can in each lane reaches end plate 25, it impinges on finger 24*a* protruding through the end plate into that lane. The force of the moving cans pressing against fingers 24*a* cause swinging members 24 to rotate about shaft 22, to the positions shown in FIG. 10 (compare FIG. 7), aligning each aperture 26 with the beam of photoelectric detector 28*a*–28*b*. As further described above, when the loading head is filled, i.e., the lead can in each lane has moved the associated swinging member 24 to the position shown in FIG. 10, the beam of the photoelectric detector passes through the aligned apertures 26 and produces a first electrical timing signal.

In response to this first timing signal, pneumatic piston-cylinder 132 is actuated to move product gate 128 from its normal position wherein its baffles or lane dividers are aligned with the lane dividers of the can accumulator (see FIG. 6) to the position wherein its lane dividers and the lane dividers of the can accumulator are misaligned (see FIG. 9), thereby stopping the flow of cans into the loading head.

Also in response to the first electrical timing signal, blank feeder 30 starts feeding a carton blank 32 from the top of the vertical stack of such blanks, as described above. The blank 32 moving into position as shown by the arrow in FIG. 1 actuates limit switch 42, producing a second electrical timing signal.

In response to this second timing signal, lowerator platform 46, which began the cycle in its lower stationary position, is moved vertically upward by piston-cylinder 96 towards its upper stationary position, simultaneous with the further feeding of carton blank 32. The rate at which carton blank 32 is fed into the area of the loading head and the rate at which the lowerator platform rises are selected such that the blank arrives in position in time to be supported beneath the loading head by the lowerator platform. As it is being fed, just prior to coming to rest against stop 66, the carton blank breaks the beam of photoelectric detector 64*a*–64*b* (see FIG. 4), producing a third electrical timing signal.

Figure 11:
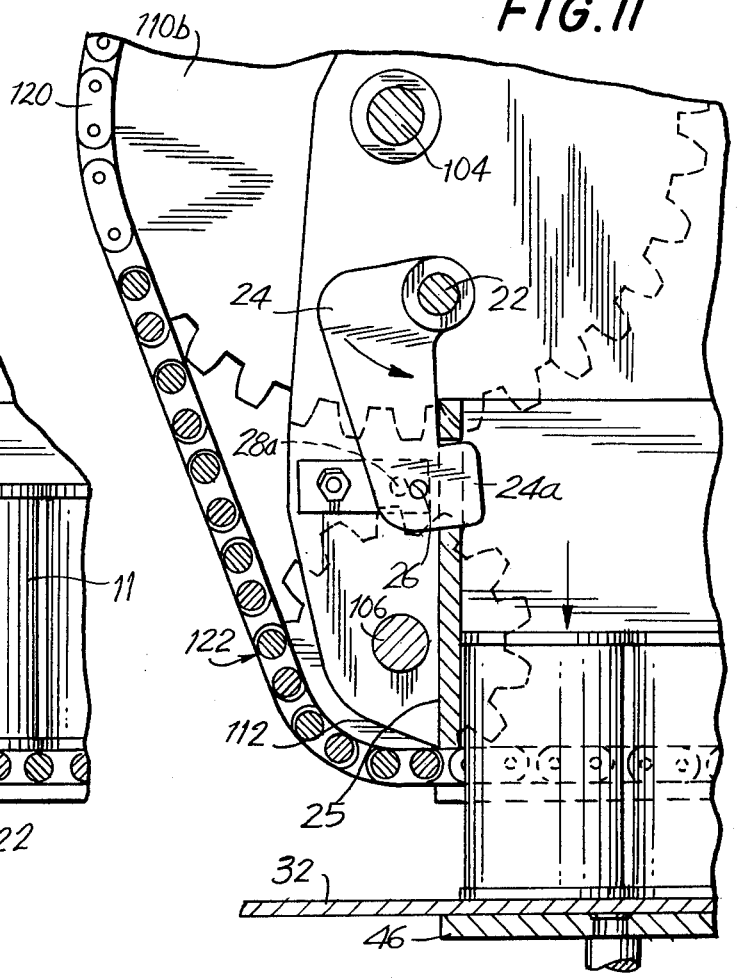
FIG. 11 is a fragmentary sectional view of the loading head showing the loading curtain withdrawn and the lowerator platform descending.
Figure 12:
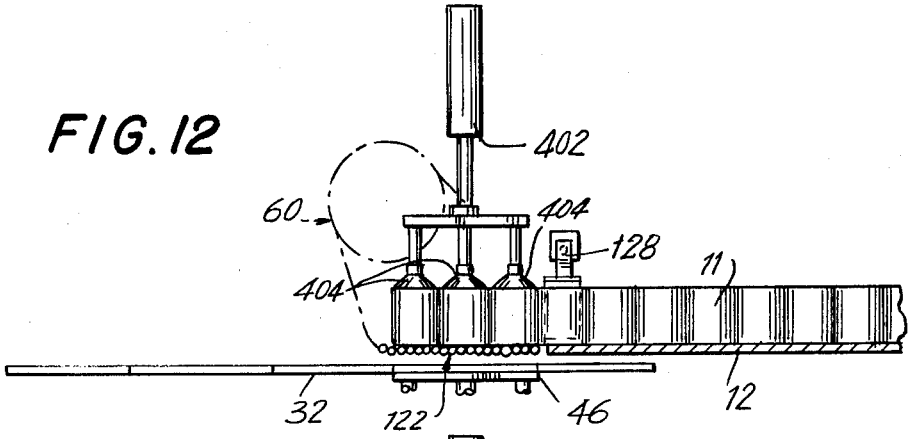
FIG. 12 is a diagrammatic view of an embodiment of the present invention adapted for packing articles in two tiers.

In response to that third timing signal, piston-cylinder 116 is actuated to turn large sprocket wheels 110*a* and 110*b* clockwise through approximately 120°, as shown in FIG. 4. The clockwise motion of the large sprocket wheels causes endless chains 120, engaging the large sprocket wheels, and small sprocket wheels 112 and 114, to turn clockwise, which in turn causes loading curtain 122 to withdraw from its normal position, supporting cans 11 grouped in loading head 60 (see FIG. 4), to the position shown in FIG. 5. The group of cans is held in place horizontally by end wall 25 and sidewalls 102*a* and 102*b* of the loading head. The support provided by the loading curtain having been removed, gravity causes the cans to drop down as a group onto the carton blank 32 positioned on and supported by lowerator platform 46, all the while maintaining the grouping formed in the loading head, as shown in FIG. 11.

When large sprocket wheels 110*a*–110*b* reach their maximum clockwise rotation of approximately 120°, member 126 on large sprocket wheel 110*a* trips limit switch 124, producing a fourth electrical timing signal. In response to this fourth timing signal, piston-cylinder 96 is actuated to lower the lowerator platform. Member 49 on lowerator guide rod 98*a* trips intermediate limit switch 48*b*, producing a fifth electrical timing signal. In response to this fifth timing signal, piston-cylinder 116 is actuated to move large sprocket wheels 110*a* and 110*b* counterclockwise through approximately 120°, thereby returning the loading curtain to its normal position.

The counterclockwise rotation of the large sprocket wheels causes member 126 on sprocket wheel 110*a* to trip limit switch 123 when the loading curtain has returned to its normal position, producing a sixth electrical timing signal. In response to this sixth timing signal, piston-cylinder 132 is actuated to return product gate 128 to its normal position, permitting the flow of cans into the loading head to resume (see FIG. 8). In this way, the next group of cans to be packed is permitted to flow into and fill the loading head, while the previous group is still being packaged on the lowerator platform.

The folding, or wrapping, of the carton blank around the group of cans placed on the blank by the loading head is commenced during the descent of the lowerator platform from its uppermost to its lowermost position.

Figure 5:
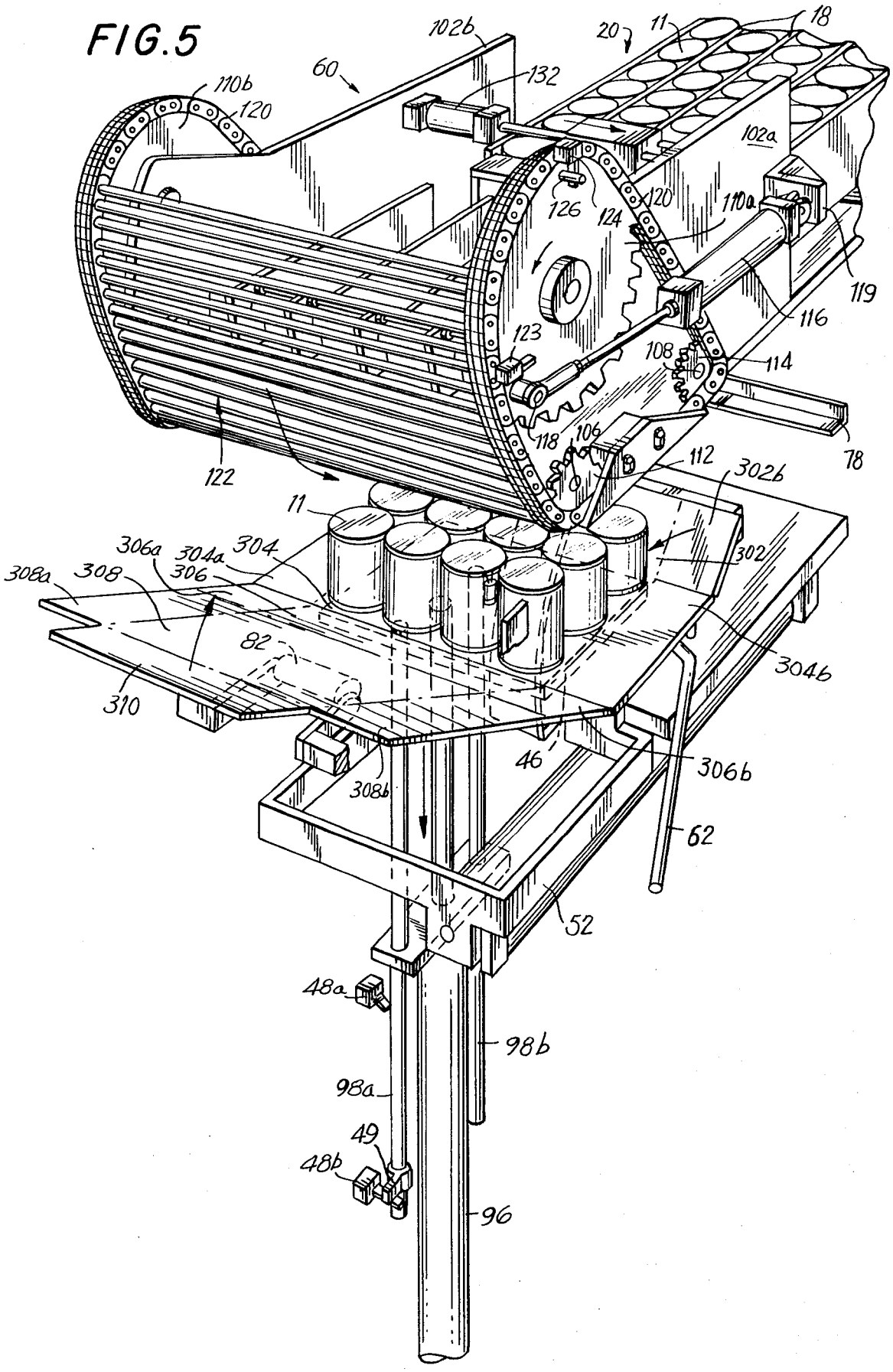
FIG. 5 is a fragmentary front perspective view of the the loading head and lowerator of the apparatus of FIG. 1, shown with the loading curtain withdrawn and the lowerator platform descending.
Figure 6:
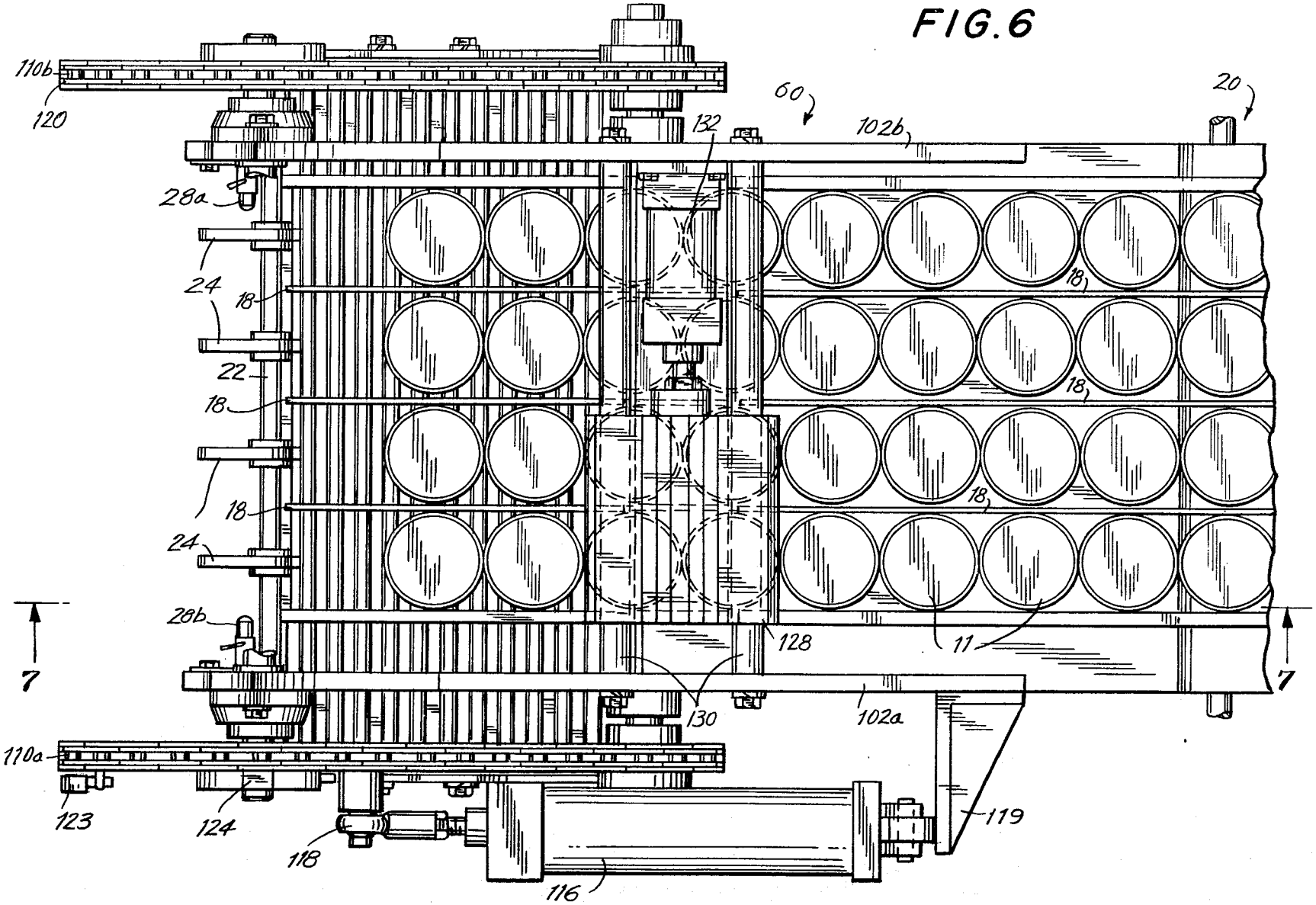
FIG. 6 is a fragmentary top plan view of the loading head and can accumulator of the apparatus of FIG. 1, shown with the loading head partially filled.

As the lowerator platform begins its descent, ledge 78 and arcuate member 58 upwardly fold rear panel 302 (see FIG. 1) of the carton along its score line, as shown in FIG. 5. Front panel 306 and top panels 308 and 310 are folded upwardly along the score lines between panels 304 and 306 by horizontal flap folder 82.

When the lowerator platform reaches its lower position, as in FIG. 3, member 49 trips limit switch 48*c*, producing a seventh electrical timing signal actuating piston-cylinder 55, which operates minor flap folders 62 to inwardly fold rear minor flaps 302*a* and 302*b* (FIG. 1). The seventh timing signal also actuates piston-cylinder 54 which drives ram 52 forward, moving the carton from the lowerator platform onto moving conveyor 76 of the gluing and sealing station 50, and piston-cylinder 84, which raises horizontal flap sealer 80.

As the carton is being pushed from the lowerator platform to the gluing and sealing station by ram 52, front minor flaps 306*a* and 306*b* are folded inwardly by plow members (not shown) on either side of the gluing and sealing station. Other adjustable plow members (not shown) upwardly fold the top and bottom major side flaps 304*a*, 304*b*, 308*a* and 308*b*, at approximately a 45° angle to the horizontal. As the carton moves through the gluing and sealing station on conveyor 76, horizontal flap folder 82 folds over the top flaps 308 and 310 to a substantially horizontal orientation parallel to bottom flap 304 and, as the carton passes glue guns 68, adhesive is applied to folded mirror flaps 302*a*, 302*b*, 306*a* and 306*b*. Timing for the application of adhesive by glue guns 68 is provided by limit switch 92, which is actuated as the filled carton is pushed by the ram from the lowerator platform onto conveyor 76, to produce a timing signal. This timing signal also acts as a safety check, in that the lowerator platform will not begin to rise in response to the "second" timing signal described above until limit switch 92 is actuated by the carton leaving the lowerator platform, indicating that the platform is empty.

Partially folded side flaps 304*a*, 304*b*, 308*a* and 308*b* are urged into adhesive contact with minor flaps 302*a*, 302*b*, 306*a* and 306*b* by side flap sealers 88 operated by pneumatic piston-cylinders 90. Finally, piston-cylinder 84 lowers flap sealer 80 as the carton passes underneath it to fold downwardly flap 310 and to urge that flap (to which an adhesive was applied in feeding station 30) into adhesive contact with end flap 302. Thereafter, the packed and sealed carton 77 is transported away from the packing apparatus by conveyor 76.

Of course, it will be understood that the above description of the folding and sealing operation is exemplary, and it will be appreciated that other folding and sealing apparatus known to the art could be substituted for that described above without departing from the spirit and scope of the invention.

FIGS. 12–15 show diagrammatically another preferred embodiment of the present invention. This apparatus achieves a two-tiered arrangement of the packed articles, for more efficient packing, and makes use of substantially the same apparatus as depicted in FIGS. 1–11 and as described above. For clarity, and to avoid repetition, the previous detailed description of the operation of that apparatus is not reproduced here. However, it should be understood that generally the structure, descriptions and principles of operation set forth above with regard to FIGS. 1–11 are applicable also to the embodiment of the present invention shown in FIGS. 12–15.

Thus, referring to FIGS. 12–15, cans 11, can accumulator 20, conveyor belt 12, carton blank 32, product gate 128, loading head 60 (shown in phantom), loading curtain 122 and lowerator platform 46 described in detail with respect to FIGS. 1–11 are shown. In addition, pneumatic piston-cylinder 402 and, attached thereto, vertically movable suction heads 404 positioned over the loading head, in particular, over loading curtain 122, are provided. One such suction head is provided for each can or other article to be packed in a tier, e.g., for the exemplary 4×3 arrangement used herein, 12 such suction heads would be used.

Figure 13:
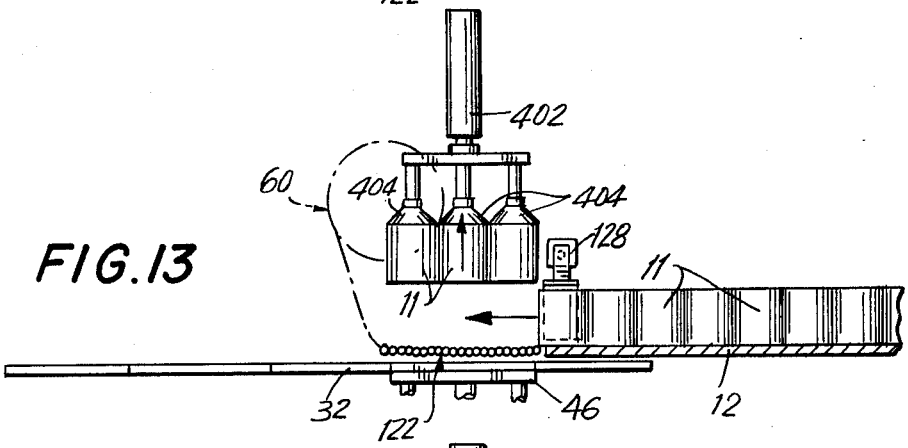
FIG. 13 is a diagrammatic view of the apparatus of FIG. 12, showing the raising of the upper tier of articles to be packed and the feeding of the lower tier of articles into the loading head.
Figure 14:
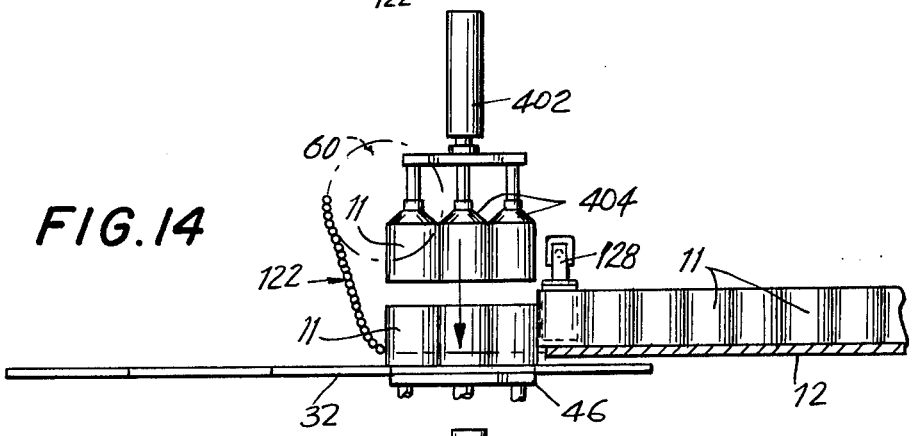
FIG. 14 is a diagrammatic view of the apparatus of FIG. 12, showing the release of the upper and lower tiers of articles onto the carton blank on the lowerator platform.
Figure 15:
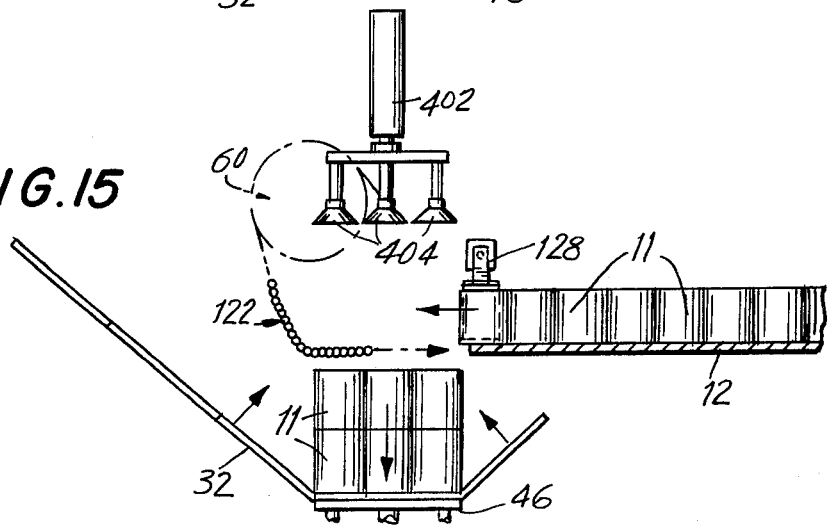
FIG. 15 is a diagrammatic view of the apparatus of FIG. 12, showing the loading curtain moving back into place and the carton blank being folded along its score lines around the articles on the lowerator platform.

Broadly speaking, the piston-cylinder and suction head assembly are adapted to lift and suspend the first (upper) tier of cans entering the loading head from the can accumulator above a second (lower) tier of cans entering the head (FIG. 13). With the product gate preventing the flow of cans into the loading head, the loading curtain is withdrawn (FIG. 14), allowing the lower tier to drop onto the lowerator platform, and the suction source (not shown) to the suction heads is disconnected, releasing the upper tier and permitting the cans therein to drop onto the lower tier (FIG. 15). As the lowerator platform descends, the carton blank is folded, or wrapped, around the two-tiered arrangement of articles as the next group of articles is being formed in the loading head, in the manner described above.

In this two-tier embodiment, the timing of the apparatus described with respect to FIGS. 1–11 is modified slightly. Thus, when an electrical signal indicating that loading head 60 is full (referred to above as the "first electrical timing signal") is produced, a suction source is connected to suction heads 404 and piston-cylinder 402 is actuated to lift the upper tier of cans. Product gate 128 remains opened, permitting the lower tier of cans to enter the loading head. (This is in contrast to the one-tier embodiment of FIGS. 1–11, wherein the "first" timing signal closed the product gate.)

On the occurrence of the next electrical timing signal, indicating that the can accumulator is again full, produce gate 128 is closed. Thereafter, the packing process continues as described with respect to FIGS. 1–11, up to the point when the "fourth" electrical timing signal, described above, is produced. That signal is produced when large sprocket wheels 110*a* and 110*b* reach their maximum clockwise rotation, fully retracting the loading curtain. In addition to actuating piston-cylinder 96 to lower the lowerator platform, as in the one-tier embodiment, this timing signal in the two-tier embodiment also causes the disconnecting of the suction source from suction heads 404, causing the upper tier of cans to be released, as shown in FIGS. 14 and 15. Gravity causes the momentarily unsupported tiers to drop through the horizontal opening in the loading head while maintaining the grouping formed in the loading head, thereby stacking the upper tier on the lower tier, with both tiers being supported by the carton blank positioned on the lowerator platform.

The above description of the timing signals used with respect to the embodiment of FIGS. 12–15 is plainly exemplary, and it should be understood that minor variations in the timing could be made without departing from the spirit or scope of this invention.

Moreover, it will be appreciated that the above principles set forth with respect to both the one-tier and two-tier embodiments of this invention could with minor modifications readily be applied to dispensing of articles other than cans (e.g., to other circular containers such as bottles, jars, or to non-circular containers) without departing from the spirit or scope of the invention.

I claim:

1. Apparatus for packing a plurality of articles in paperboard cartons, each said carton being initially in the form of a carton blank having a plurality of score lines defining the panels and flaps of the paperboard carton to be formed therefrom, comprising:

(a) means for feeding to the packing apparatus a plurality of articles to be packed;

(b) means for forming discrete groups of said articles provided by said feeding means, said discrete groups of articles conforming generally to the physical dimensions of the carton to be packed;

(c) first means for supporting each of said groups of articles, said first supporting means being releasable to cause each said discrete group of articles to drop vertically when released;

(d) means for positioning a carton blank beneath said first supporting means, to receive each said group of articles when released by said first supporting means;

(e) second means for supporting both said carton blank positioned beneath said first supporting means and said group of articles received by said carton blank;

(f) timing means cooperating with said group forming means, said first supporting means, said carton blank positioning means and said second supporting means, for causing said first supporting means to release said group of articles and for causing the positioning and supporting of each said carton blank beneath said group of articles to receive said group of articles when released; and (g) means cooperating with said second supporting means for folding the carton blank substantially to wrap said carton blank around said group of articles received by said carton blank to form a carton, said timing means further cooperating with said feeding, said group forming, said first and second supporting and said folding means to permit the forming of a subsequent group of articles to be packed supported by said first supporting means while said folding means is simultaneously wrapping said carton blank around a first group of said articles.

2. The apparatus of claim 1 wherein said first supporting means comprises a plurality of parallel spaced rotatable members horizontally disposed to form a loading curtain beneath said group of articles to be supported and means for withdrawing said loading curtain from beneath said group of articles by retracting said loading curtain in a generally horizontal direction while holding said group of articles horizontally stationary in said grouping means.

3. A method for packing a plurality of paperboard cartons, each said carton being initially in the form of a carton blank having a plurality of score lines defining the panels and flaps of the carton, comprising the steps of:

(a) feeding a plurality of articles to be packed;
(b) forming said articles into a discrete group conforming generally to the physical dimensions of the cartons to be packed;
(c) supporting said discrete group of articles;
(d) positioning said carton blank below said supported group of articles for receiving said group of articles and supporting said carton blank beneath said supported group;
(e) removing the support from said discrete group of articles, causing said articles to drop onto said carton blank;
(f) folding said carton blank to wrap the blank around the group of articles to form a carton;
(g) simultaneous with said folding step (f), feeding an additional plurality of articles to be packed, forming a next discrete group of said articles to be packed and supporting said next group of articles until said folidng step is substantially completed;
(h) positioning a next carton blank below said supported next group of articles for receiving said group of articles and supporting said carton blank beneath said group of articles; and
(i) repeating said steps (e)–(h) above.

4. The method of claim 3 wherein the step (b) of forming the articles into a discrete group further comprises arranging each said group into an upper tier of articles and a lower tier of articles, said upper tier being lifted and supported above said lower tier, wherein the step (e) of removing support from the discrete group of articles further comprises simultaneously removing support from both the upper and lower tiers of articles in the group, and wherein the step (g) of forming the next discrete group of articles further comprises arranging the group in an upper and lower tier of articles and lifting and supporting said upper tier above said lower tier as in step (b).

5. Apparatus for packing a plurality of articles in two tiers in paperboard cartons, each said carton being initially in the form of a carton blank having a plurality of score lines defining the panels and flaps of the carton, comprising:

(a) means for feeding the plurality of articles to be packed to the packing apparatus;
(b) means for forming discrete groups of said articles to be packed, said groups conforming generally to the physical dimensions of the carton to be packed;
(c) means for lifting the first of said discrete groups of articles to create an upper tier, said lifting means being releasable to permit said upper tier of articles to drop vertically when released;
(d) first supporting means for supporting the next of said discrete groups of articles provided by said group forming means beneath said upper tier to create a lower tier of said articles, said first supporting means being releasable to permit said lower tier of articles to drop vertically when released;
(e) means for positioning a carton blank beneath said lifting means and said first supporting means, for receiving said lower tier of articles when released by said first supporting means and said upper tier of articles when released by said lifting means;
(f) second supporting means for supporting both said carton blank positioned beneath said first supporting means and said upper and said lower tiers of articles received by said carton blank;
(g) timing means cooperating with said group forming means, said lifting means and said first and second supporting means, for causing said lifting means to lift said upper tier of articles while said lower tier of articles is being formed by said group forming means, for causing said lifting and said first supporting means to simultaneously release said upper and said lower tiers of articles to be packed, and for causing the positioning of each said carton blank and said second supporting means beneath said groups of articles to receive both said tiers when released; and
(h) means cooperating with said second supporting means for folding the carton blank substantially to wrap the carton blank around said tiers of articles to form a carton, said timing means further cooperating with said feeding, said group forming, said first and second supporting and said folding means to cause the forming of subsequent upper and lower tiers of articles supported by said lifting means and said first supporting means while said folding means is wrapping said carton blank around said upper and said lower tiers of articles.

6. Apparatus for packing a paperboard carton initially in the form of a blank, comprising:

(a) feeding means including a conveyor for supplying a plurality of said articles to the packing apparatus;
(b) means for feeding one of a plurality of carton blanks from a stock of said blanks;
(c) a loading head adapted for receiving the supply of articles provided by said article feeding means and for grouping said articles into discrete groups whose dimensions correspond to the physical dimensions of the carton to be packed;
(d) a retractable loading curtain associated with the loading head comprising a plurality of parallel, horizontally spaced rotatable members disposed beneath the groups of articles formed by the loading head and adapted and arranged for supporting those articles in the loading head;
(e) means associated with the loading head for retracting said loading curtain to release said group of articles formed in the loading head and for returning said loading curtain to its normal position for supporting the next group of articles formed in the loading head;
(f) gate means associated with the loading head and said article supply means for preventing the flow of articles from said supply means from entering said loading head while said loading curtain is retracted and for resuming said flow of articles when said loading curtain is restored to its normal position;
(g) vertically movable support means beneath the loading head having a first stationary level for positioning and supporting each said carton blank fed by said blank feeding means beneath said loading head and for receiving the momentarily unsupported groups of articles when said loading curtain is retracted and having a second stationary level;

(h) means associated with said movable support means for vertically moving said support means from said first to said second stationary level, and at the same time folding the carton blank supported by said movable support means around said group of articles to be packed substantially to form a carton; and (i) timing means associated with said loading curtain and said gate means for returning the loading curtain to its normal position and for operating said gate means so as to permit the flow of articles into the loading head to be resumed, simultaneous with the folding of said blank to form a carton.

7. The apparatus of claim 6, further comprising sealing and discharge means at the second stationary level of said movable support means for completing the forming of the carton and adhesively sealing the flaps thereof, and for discharging the carton from the packing apparatus.

8. The apparatus of claim 7 wherein the articles to be packed follow the same horizontal direction of travel through said article feeding means, into said loading head, and through said sealing and discharging means.

9. The apparatus of claim 6 wherein the horizontally spaced parallel rotatable members comprising the loading curtain are rotatably attached to and supported on either end by an endless chain, and wherein said means for retracting said load curtain comprises:

a pair of sprocket wheels journaled for rotation to the loading head, each of said sprocket wheels engaging one of said endless chains supporting said loading curtain; and a pneumatic piston-cylinder connected to the loading head and to the sprocket wheels, said piston-cylinder being arranged and adapted for rotating said pair of sprocket wheels together in one or the other direction to respectively withdraw the loading curtain from or return said loading curtain to its position supporting said group of articles formed in the loading head.

10. The apparatus of claim 6 wherein said article feeding means and said loading head are divided into a plurality of lanes, and wherein the plurality of lanes in said feeding means correspond in number and position to the plurality of lanes in said loading head.

11. The apparatus of claim 10 wherein said gate means comprises a plurality of lanes corresponding in number to the lanes of the feeding means and the loading head, and wherein the gate is adapted to prevent the flow of articles from said article supply means from entering said loading head by causing a misalignment between the lanes of the gate means and those of the feeding means and loading head.

12. The apparatus of claim 6, further comprising:

(j) means associated with the loading head for lifting and supporting every other one of said discrete groups of articles above the next following discrete group of said articles to create an upper and lower tier arrangement of said discrete groups of articles; and (k) means associated with said lifting and supporting means for releasing said lifted and supported upper tier of articles simultaneously with the release of said lower tier of articles by the loading curtain.

13. The apparatus of claim 12 wherein the lifting and supporting means for the upper tier of said articles comprises a plurality of suction heads and associated pneumatic piston-cylinder means for raising and lowering said suction heads.

* * * * *